US010724141B2

(12) United States Patent
Montero Herrero et al.

(10) Patent No.: US 10,724,141 B2
(45) Date of Patent: Jul. 28, 2020

(54) ANTI-MULTIPACTOR DEVICE

(71) Applicants: CONSEJO SUPERIOR DE INVESTIGACIONES CIENTÍFICAS (CSIC), Madrid (ES); EUROPEAN SPACE AGENCY (ESA), Paris (FR); TESAT-SPACECOMO GMBH & CO. KG, Backnang (DE)

(72) Inventors: Isabel Montero Herrero, Madrid (ES); Lydya Sabina Aguilera Maestro, Madrid (ES); David Raboso García-Baquero, Paris (FR); Ulrich Wochner, Backnang (DE)

(73) Assignees: CONSEJO SUPERIOR DE INVESTIGACIONES CIENTIFICAS (CSIC), Madrid (ES); TESAT-SPACECOMO GMBH & CO. KG, Backnang (DE)

( * ) Notice: Subject to any disclaimer, the term of this patent is extended or adjusted under 35 U.S.C. 154(b) by 355 days.

(21) Appl. No.: 15/511,220

(22) PCT Filed: Sep. 16, 2015

(86) PCT No.: PCT/ES2015/070674

§ 371 (c)(1),
(2) Date: Sep. 5, 2017

(87) PCT Pub. No.: WO2016/042192

PCT Pub. Date: Mar. 24, 2016

(65) Prior Publication Data

US 2017/0292190 A1 Oct. 12, 2017

(30) Foreign Application Priority Data

Sep. 16, 2014 (ES) ..... 201431344

(51) Int. Cl.
*C23C 18/16* (2006.01)
*C23C 18/18* (2006.01)
(Continued)

(52) U.S. Cl.
CPC ..... *C23C 18/1669* (2013.01); *C23C 18/165* (2013.01); *C23C 18/1841* (2013.01);
(Continued)

(58) Field of Classification Search
CPC ..... C23C 18/1669; C23C 18/44; C23C 18/38; C23C 18/165; C23C 18/1841; G21F 1/125; H01J 23/12
See application file for complete search history.

(56) References Cited

U.S. PATENT DOCUMENTS

| | | | |
|---|---|---|---|
| 4,559,281 | A | 12/1985 | Derfler et al. |
| 2009/0261926 | A1 | 10/2009 | Wolk et al. |
| 2013/0033343 | A1 | 2/2013 | Fisher et al. |

FOREIGN PATENT DOCUMENTS

| | | | |
|---|---|---|---|
| CN | 102515085 A | * | 6/2012 |
| CN | 102816997 | | 12/2012 |
| DE | 102011053949 | | 3/2013 |
| WO | WO-2009115083 | | 9/2009 |

OTHER PUBLICATIONS

Espacenet translation to English for CN 102816997, accessed Jul. 30, 2019 (Year: 2012).*

(Continued)

*Primary Examiner* — Nancy R Johnson
(74) *Attorney, Agent, or Firm* — Womble Bond Dickinson (US) LLP

(57) ABSTRACT

The invention relates to anti-multipactor coating deposited onto a substrate that can be exposed to the air and its procedure of obtainment by simple chemical methods. Furthermore, the present invention relates to its use for the fabrication of high power devices working at high frequencies.

15 Claims, 6 Drawing Sheets

(51) Int. Cl.

| | |
|---|---|
| ***C23C 18/38*** | (2006.01) |
| ***C23C 18/44*** | (2006.01) |
| ***G21F 1/12*** | (2006.01) |
| ***H01J 23/12*** | (2006.01) |

(52) U.S. Cl.
CPC ..... *C23C 18/38* (2013.01); *C23C 18/44* (2013.01); *G21F 1/125* (2013.01); *H01J 23/12* (2013.01)

(56) References Cited

OTHER PUBLICATIONS

Espacenet translation to English for CN 102515085, accessed Jul. 30, 2019 (Year: 2012).*

PCT Search Report dated Dec. 15, 2015, International Application No. PCT/ES2015/070674.

Furman, et al., "Simulation of Secondary Electron Emission Based on a Phenomenological Probabilistic Model", LBNL-52807, SLAC-PUB-9912, (Jun. 2, 2003), 1-31.

Montero, et al., "Novel Types of Anti-ECLOUD Surfaces", (Aug. 6, 2013), 1-4.

Montero, et al., "Secondary electron emission under electron bombardment from graphene nanoplatelets", Applied Surface Science 291, (2014), 74-77.

Nistor, et al., "Strategies for Anti-Multipactor Coatings of Suppressed Secondary Emission and Low Insertion Losses for High Power RF Components in Satellite Systems", (2008), 1-11.

Nistor et al., "Multipactor suppression by micro-structured gold/silver coatings for space applications", Applied Surface Science, Available online: May 20, 2014, vol. 315, pp. 445-453.

* cited by examiner

3a

3b

3c

ANTI-MULTIPACTOR DEVICE

CROSS-REFERENCE TO RELATED APPLICATIONS

The present patent application is a national phase application of International Application No. PCT/ES2015/070674, filed Sep. 16, 2015, which claims priority to Spanish Application No. P201431344, filed Sep. 16, 2014, the disclosures of which are incorporated herein by reference.

DESCRIPTION

The invention relates to anti-multipactor coating deposited onto a substrate that can be exposed to the air and its procedure of obtainment by simple chemical methods. Furthermore, the present invention relates to its use for the fabrication of high power devices working at high frequencies.

STATE OF ART

In high power devices for space, secondary electron emission governs a multipactor effect which is a resonant vacuum electron avalanche detected in microwave (MW) and radio frequency (RF) space instrumentation, large accelerator structures and thermonuclear toroidal plasma devices; which are manufactured in a wide array of geometries and which are working in a frequency range from MHz range up to tens of GHz. The fundamental mechanism behind this serious problem of multipactor discharge is the electron discharge caused by secondary electron emission (SEE); therefore, multipactor discharge imposes a limit on the total power that may be transmitted by a high powered system in vacuum.

Multipactor is a serious issue in fields of great technological importance such as high power RF hardware in space, high-energy particle accelerators, and klystrons and other high-power RF vacuum tubes. The resonance conditions of multipactor can often be inhibited by an adequated design of parameters pertaining the RF electromagnetic field; but, there remain always critical regions where that resonance conditions can only be avoided by using low-secondary emission surfaces.

It has been suggested that a key issue for the manufacture of future advanced devices for space is the development of anti-multipactor coatings which should have good surface electrical conductivity for avoiding RF losses, large resistance to air exposure and low SEE. Surface roughness can be an issue in power loss in metallic materials because of the high surface electrical resistance or high insertion loss, or even small skin depth at high frequencies. In the limit of high frequencies, the induced current in the material is strictly localized into the surface and the resistance increases in the ratio of the area of the roughened surface to the projected area (for transversal 2D roughness). For lower frequencies, the induced current distributes exponentially in depth according to the skin depth and the surface resistance decreases with the dc resistance as a limit. In a waveguide of conductive metallic surfaces, the power attenuation measured in dB (the insertion loss IL) is proportional to the RF surface resistance.

Well-known techniques for reducing the secondary electron emission yield (SEY) are surface roughness cleaning/conditioning or surface roughness increase [I Montero et al "Novel types of anti-ecloud surfaces", ECLOUD12 Proceedings—CERN (2012)]. For many years silver has been used in different electric devices due to its high electrical conductivity, for instance, in high quality RF connectors and RF devices working under vacuum conditions. Silver presents a secondary electron emission coefficient (SEY) higher than 2 after exposure to air. However, to prevent multipactor discharge it is mandatory to use surfaces with low SEY, lower than 1.1. Many researchers have attempted to overcome these problems.

Rough coatings applied to the silver surface can substantially reduce SEY [M. A. Furman and M. T. F. Pivi, "Simulation of secondary electron emission based on a phenomenological probabilistic model", LBNL-52807, SLAC-PUB-9912 (2013).

"Multipactor suppression by micro-structured gold/silver coatings for space applications", Applied Surface Science, in-press, available online 20 May 2014, January 2014 describes a complicated and very expensive preparation method for suppressing multipactor effect in space instrumentation comprising micro-structured gold/silver coatings. In that work the measured SEY is high (SEY=1.3) and multipactor discharge was detected.

Etching of the flat silver coatings for increasing the surface roughness and thus achieving low-SEE and low insertion loss is a method that has been described previously. Nevertheless etching of flat surfaces only produced a moderate decrease of SEY (up to SEY>1) and a strong increase of the insertion loss. In addition the mechanical properties of the silver deteriorated after that particular etching process. [Rf component and the method thereof for surface finishing WO 2009115083 A3 and V. Nistor, L. Aguilera, I. Montero, D. Raboso, L. A. Gonzalez, L. Soriano, L. Galan, U. Ulrich, D. Wolk, Porceeding of MULCOPIM 2011, Valencia].

Air exposure produces a so important increase of SEY that coatings can become unusable for anti-multipactor applications, for instance, an increase from 0.5 to 2. Multilayer coatings with a low SEY that prevents interference resulting from secondary electron emission can be found in the state of art (for example U.S. Pat. No. 4,559,281A). Nevertheless, no reference to the effect of the exposure to the air is disclosed.

Furthermore, graphene flakes coatings were also studied for this application but its theoretical high insertion loss values (3.1 dB) are not suitable for these applications [I. Montero et al "Secondary electron emission under electron bombardment from graphene nanoplatelets", Applied Surface Science January 2014, 291, 74-77]. US20090261926A1 discloses a method of reducing multipactor effect occurrence on surfaces RF devices. The method includes forming porous layer of Anomag disposed over the wall material surface and a conductive layer disposed over the porous layer upper surface. Anomag is an oxide layer and for this reason its resistivity is higher than a metallic layer. The consequent expected high insertion loss values are not adequate for a normal operation of these RF high power devices.

For the reasons stated above, it is needed to develop anti-multipactor coatings with low SEY, low insertion loss and high resistance to air exposure.

DESCRIPTION OF THE INVENTION

The invention relates to a low secondary electron emission material. It is a rough anti-multipactor coating deposited onto a substrate consisting of a metal or a mixture of metals that can be exposed to the air and still maintains a low SEY and a low insertion loss.

Furthermore the invention relates to the procedure of obtainment of the anti-multipactor coating by simple chemical methods. This process enhanced height-to-width grooves aspect ratios to inhibit multipactor effect. The main potential advantages of this nano-microtechnology technique are the following:

- It is capable of producing surface roughness of sizes from the micrometer to the nanometer scales.
- Aspect ratio of surface roughness can be very high and controlled by the conditions of the preparation process.
- The incorporation of chemical species of the dissolution "contamination" during this procedure is negligible.
- It is capable of easily treat large surface areas compared to other nanotechnology techniques having more detailed control on the surface structures produced and it is not an expensive method.

Additionally, the present invention relates to its use for the fabrication of high power devices working at high frequencies.

A first aspect of the present invention relates to an anti-multipactor coating deposited onto a substrate characterized in that

- it comprises at least two contacting high conductive metal layers, with an electrical conductivity greater than $4\times10^7$ $S\cdot m^{-1}$,
- it has a secondary electron emission yield below 1 in air, between 0.4 and 0.9, for a incident electron energy range between 0 and 5000 eV,
- it has a final surface roughness with a grooves aspect ratio greater than 4, with a surface grooves density >70%,
- and it has a insertion loss of between 0.1 and 0.14 dB, and
- wherein the substrate consists of a metal or a mixture of metals.

In the present invention the term "anti-multipactor coating" describes a coating deposited onto a substrate that prevents or decreases the secondary electron emission detected in high power devices working at high powers of the orders of $10^2$ W in RF space instrumentation. This means, the anti-multipactor coating deposited onto a substrate prevents or decreases the resonant vacuum electron avalanche detected in the mentioned devices.

The anti-multipactor coating deposited onto a substrate of the present invention has a secondary electron emission yield below 1 in air, between 0.4 and 0.9, for an incident or primary electron energy range between 0 and 5000 eV.

The anti-multipactor coating deposited onto a substrate of the present invention can be exposed to air, it maintains its low SEY even after long air exposure.

The term "grooves aspect ratio" as used herein defines the final surface roughness of the anti-multipactor coating of the present invention and refers to the geometric shape of the grooves, this means, the ratio of the depth to dwell width.

The grooves aspect ratio of the anti-multipactor coating of the present invention is greater than 4 with a surface grooves density >70%.

The term "insertion loss" as used herein refers to the loss of signal power of the anti-multipactor coating deposited onto a substrate of the present invention. For instance, insertion loss is a figure of merit for an electronic filter and this data is generally specified with a filter; it is defined as a ratio of the signal level in a test configuration without the filter installed to the signal level with the filter installed. This ratio is described in dB.

The anti-multipactor coating deposited onto a substrate of the present invention is characterized by an insertion loss of between 0.1 and 0.14 dB.

Thus, a preferred embodiment of the present invention provides an anti-multipactor coating deposited onto a substrate wherein the substrate consist of a metal or a mixture of metals selected from Ni doped with P, Al, Cu and Ag.

In a preferred embodiment, the high conductive metal of each layer forming the anti-multipactor coating described above is selected independently from Au, Ag and Cu; more preferably is selected independently from Ag and Cu.

In another preferred embodiment, the secondary electron emission yield of the anti-multipactor coating described above ranges values between 0.4 and 0.9 for an incident or primary electron energy range between 0 and 5000 eV.

A second aspect of the present invention relates to a process of obtainment of the anti-multipactor coating deposited onto a substrate described previously wherein the process comprises at least the following steps:

a) deposition of a high conductive metal, with an electrical conductivity greater than $4\times10^7$ $S\cdot m^{-1}$, onto a substrate, b) etching of the deposited high conductive metal layer of step a) by an acid dissolution c) activating of the etched layer obtained in step b), and d) electroless plating of a high conductive metal, of an electrical conductivity greater than $4\times10^7$ $S\cdot m^{-1}$, onto the activated etched layer obtained in step c) using a solution of high conductive metal ions and a reducing agent.

Preferably, step a) relates to the deposition of a high conductive metal layer, made of Ag or Cu.

In a preferred embodiment, the deposition is performed by conventional deposition techniques such as chemical deposition techniques such as plating, chemical solution deposition, spin coating, chemical vapor deposition and atom layer deposition, and/or physical deposition techniques such as electron beam evaporator, molecular beam epitaxy, pulsed laser deposition, sputtering, cathodic arc deposition and electrospray deposition.

Step b) describes the etching of the deposited high conductive metal layer of step a) by an acid dissolution, so that the final surface roughness is characterised with a grooves aspect ratio above 2 with a surface grooves density greater than 60%.

Etching of the flat metallic surface is a mandatory step to grow a an adequate strong metallic rough layer on it.

In a preferred embodiment, the acid dissolution of step b) comprises hydrofluoric acid, nitric acid, acetic acid, deionized water or a mixture thereof.

Preferably, the acid dissolution consists of hydrofluoric acid, nitric acid, acetic acid and deionized water in a stoichiometric ratio of 1:1:1:1.

Preferably, the acid dissolution consists of hydrofluoric acid, nitric acid and deionized water in a stoichiometric ratio of 1:1:1.

Step c) relates to the activation of the etched layer obtained in step b).

In a preferred embodiment, this activation is performed by adding an aqueous solution of $SnCl_2$ or $PdCl_2$.

More preferably, the aqueous solution of $SnCl_2$ is in a concentration range between 0.05-1.2% in weight to the etched layer obtained in step b). A rinse in deionized water is performed subsequently. Even more preferably the concentration range of the aqueous solution of $SnCl_2$ is 0.06-0.09% in weight. Sn ions will reduce the silver species to metallic Ag and the silver deposition process continues because silver is autocatalytic for the deposition of itself.

Step d) relates to the electroless plating of a high conductive metal onto the activated etched layer obtained in step c) using a solution of high conductive metal ions and a reducing agent.

Electroless plating process is based on chemical reduction reactions and does not need to apply any external electrical potential. Therefore, electroless does not require an electrical contact to the substrate; this fact increases the processing flexibility. In electroless plating, the substrate is just immersed into the plating dissolution containing reducing agents and silver ions. Conformal coverage can be provided by this electroless plating.

In a preferred embodiment, the high conductive metal used during step d) of electroless plating is selected from Au, Ag and Cu, more preferably is selected from Ag and Cu.

In another preferred embodiment, step d) of electroless plating is performed under continuous agitation and using a bath temperature between 30 and 80° C.; preferably between 40 and 70° C.

Preferably, the solution of high conductive metal ions of step d) is an aqueous solution of $AgNO_3$. More preferably, this aqueous solution is in a concentration of 0.02M.

In another preferred embodiment, the reducing agent of step d) is selected from triethanolamine, diethanolamine or monoethanolamine. More preferably, a reducing agent such as triethanolamine is slowly added drop by drop. In case of using Ag triethanolamine is slowly added until the initially formed silver oxide or silver hydroxide precipitate (solution with a brown color) is redissolved with constant stirring (colorless solution) obtaining metallic silver.

The last aspect of the invention refers to the use of the anti-multipactor coating deposited onto a substrate described previously for the fabrication of high power devices, operating at powers higher than 0.1 kW, working at high frequencies, from MHz range up to tens of GHz.

Preferably, the device is a microwave, a radio frequency device for space, thermonuclear or large accelerator instrumentation working at high power, higher than 0.1 kW, between 0.1 kW and 100 kW, more preferably between 0.1 kW and and 50 kW.

Unless otherwise defined, all technical and scientific terms used herein have the same meaning as commonly understood by one of ordinary skilled in the art to which this invention belongs. Methods and materials similar or equivalent to those described herein can be used in the practice of the present invention. Throughout the description and claims the word "comprise" and its variations are not intended to exclude other technical features, additives, components, or steps. Additional objects, advantages and features of the invention will become apparent to those skilled in the art upon examination of the description or may be learned by practice of the invention. The following examples and drawings are provided by way of illustration and are not intended to be limiting of the present invention.

EXAMPLE

Preparation of Waffle-Iron Type Filter Samples and its Characterization

A chemical deposition treatment was developed for creating an appropriate submicron surface roughness on a Ag plating of the waffle-iron type filters.

Figure 1A:
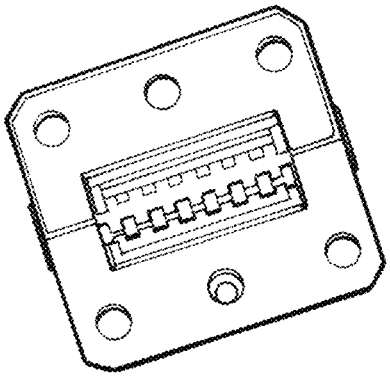
FIG. 1 *a*) photo of a Ku band filter and *b*) photo of a Ku band filter.
Figure 1B:
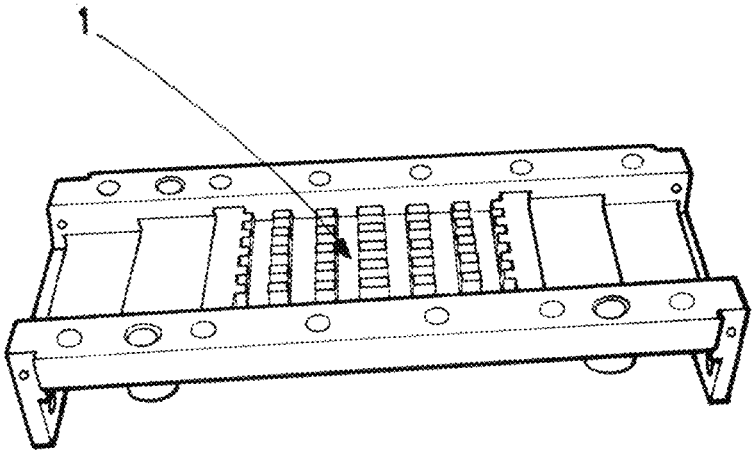

FIG. 1*a* shows a photo of a Ku band filter, FIG. 1*b* shows a photo of a Ku band filter, 1 indicates the inner part.

A silver coated aluminum sample of 2 $cm^2$ was etched in a Teflon baker of 50 ml with dissolution of $HNO_3$, HF and deionized water 1:1:1 during 10 s. The sample was cleaned in water and treated in a dissolution of $SnCl_2$ (0.03 g) and deionized water (50 ml) during 1 h.

An electroless plating process was required for the preparation of the top microstructured silver coating of the filters. The procedure was performed in a round glassware or baker of 50 ml containing $AgNO_3$ (0.25 g) and deionized water (5 ml) of 16.8 Mohms·cm; drops of triethanolamine were subsequently added and the solution take on light brown in color and subject to energetic agitation until to achieve a transparent dissolution, then more deionized water is added up to obtain 40 ml. at 40° C. The pretreated samples (prismatic shape or plates of 20×20×2 mm) were placed in the center of the baker with its small side parallel to the base of the baker during 30 min.

Figure 2:
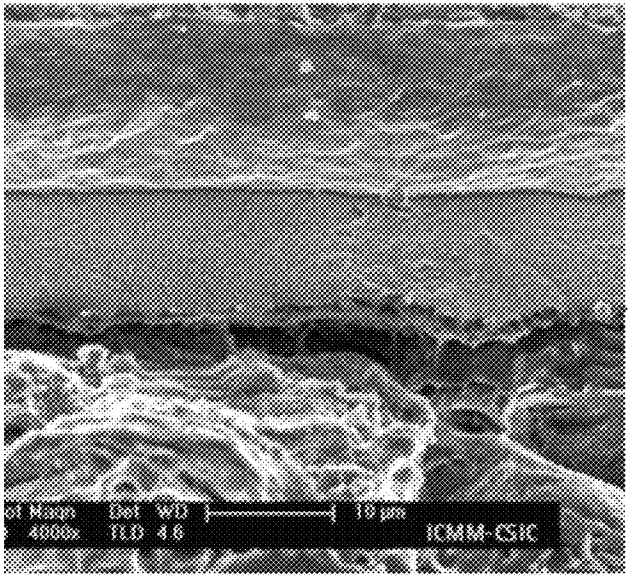
FIG. 2. Scanning electron microscopy (SEM) image of the transversal section of the silver flat coating deposited on Ni(P)/Al substrate.

FIG. 2 shows a scanning electron microscopy (SEM) image of the transversal section of the silver flat coating deposited on Ni/Al substrate.

A homogeneous silver thickness is observed along the sample surface. It is remarkable the good interlayer adhesion.

Figure 3:
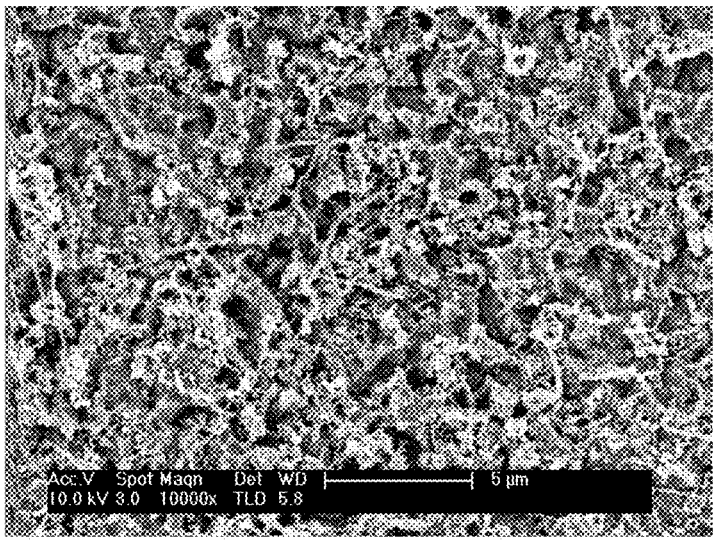
FIG. 3 SEM images of the silver coating and a scheme of the monolayer silver structure deposited on Ni(P)/Al substrate.
Figure 3:
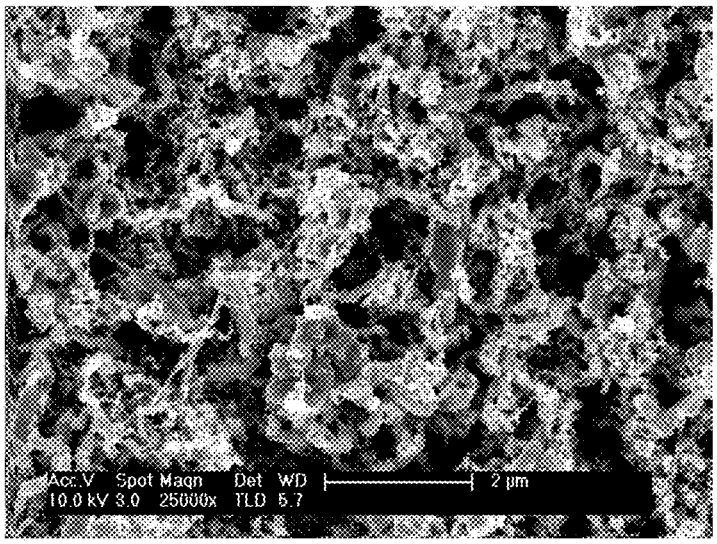
Figure 3:
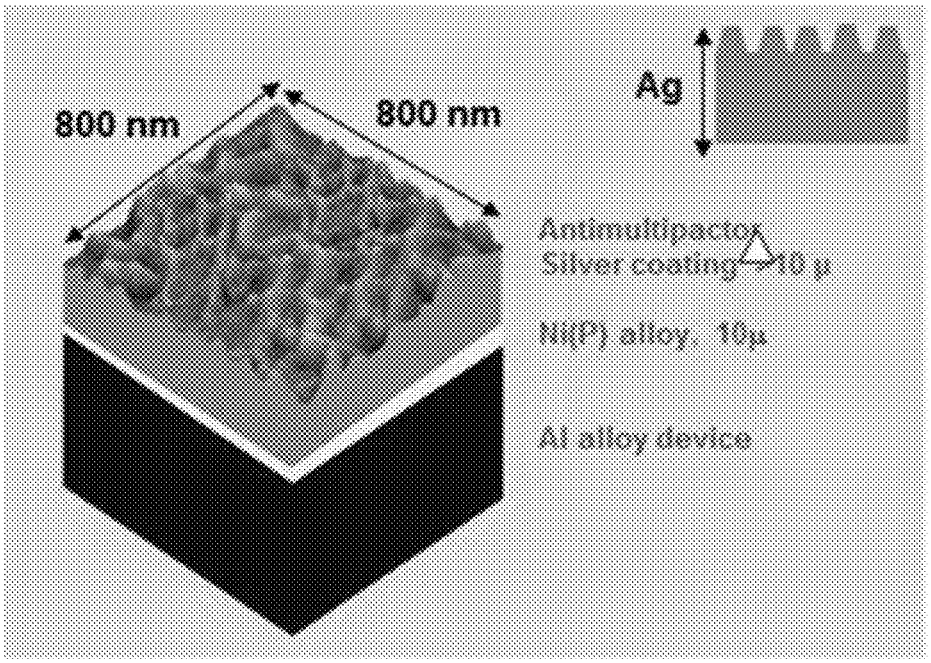

FIGS. 3 *a*) and *b*) show SEM images of the silver coating and *c*) shows a scheme of the monolayer silver structure deposited on Ni(P)/Al substrate.

The surface roughness of high aspect ratio is produced by the continuous silver growing on the previously etched surface of the standard silver plating of the aluminum alloy device. The dark black regions represent a sinkhole area of ~51%. The 3D surface shown in this figure is a realistic simulation obtained by the AFM software. In the inset of the upper right is remarked the monolayer structure of this antimultipactor coating.

SEY tests were performed in an ultra-high vacuum chamber ($<10^{-9}$ hPa) equipped with two Kimball Physics electron guns in the range 0-5000 eV, ion-gun, a concentric hemispherical analyzer. The energy of the electrons leaving the sample are determined using this analyzer and the excitation sources energetic electrons or x-ray, MgKα radiation (hvv=1253.6 eV). The sample can be rotated in front of the electron spectrometer for the surface composition or cleanliness examination, and in front of the programmable electron guns for the SEY measurements by using two micrometric XYZθ manipulators, and liquid helium cryostat for sample cooling, and also can be heated (<1200 K).

The SEY measurements were made via computer-controlled data acquisition; the sample is connected to a precision electrometer (conductive samples). The electron beam is pulsed by counter-bias of the wehnelt. The primary beam current can be measure by a Faraday cup attached to the system.

The yield of SEY(σ) is defined as a $\sigma=(I_0-I_s)I_0$.

The current $I_0$ is always negative, while $I_s$ can be positive or negative depending on the primary energy and SEY values of the sample. Low primary electron current ($I_0$<5 nA) was used to avoid surface contamination or modification.

No witness samples were required because filters can be directly measured in this SEY set-up.

Figure 4:
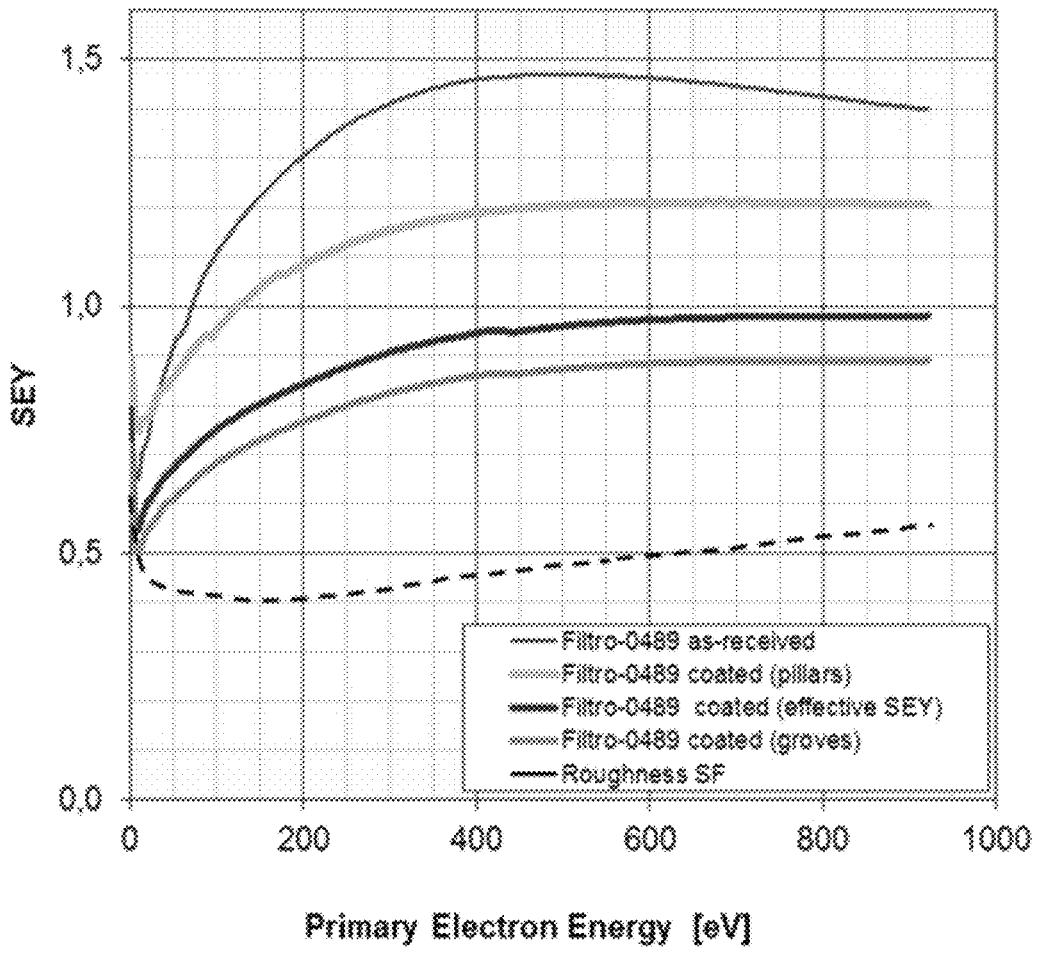
FIG. 4 SEY curves of the filter sample with the optimum roughness as measured in the corrugated part of the filter before and after anti-multipactor treatment.

FIG. 4 shows SEY curves of the filter sample with the optimum roughness as measured in the corrugated part of the filter before and after anti-multipactor treatment.

It is remarkable SEY of the coated filter is lower than 1 in all primary energy range SEY of pillars.

Figure 5:
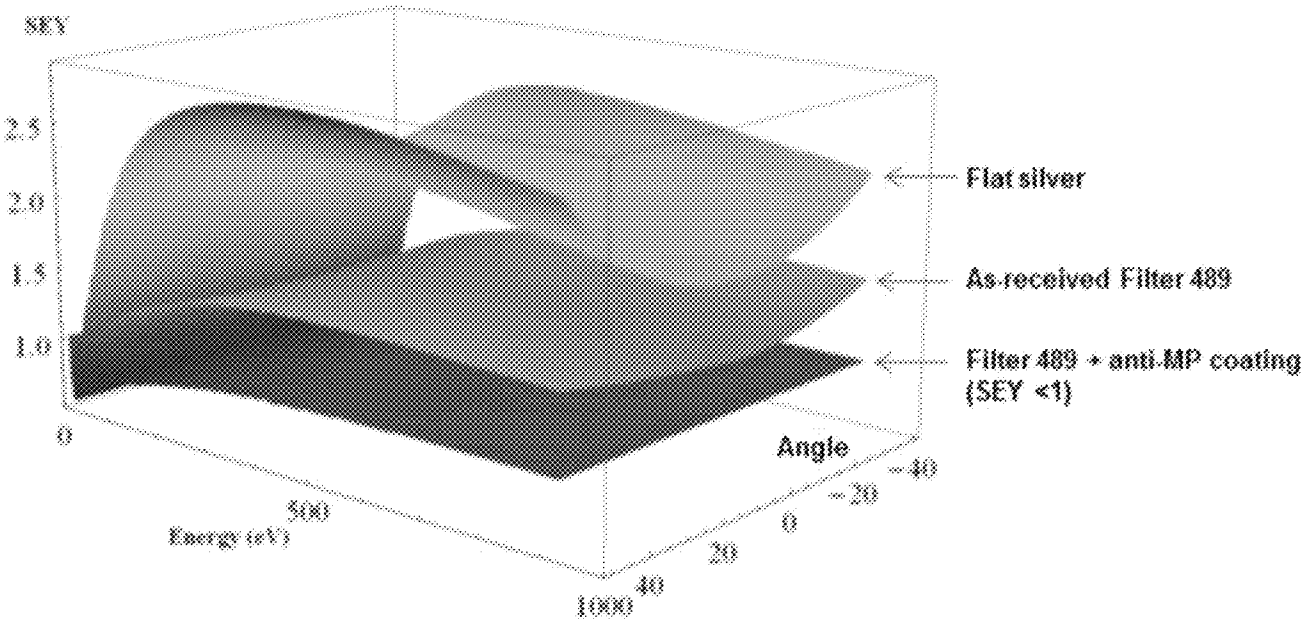
FIG. 5 Primary energy and angular dependences of the SE yield of electrons colliding with filters surface with primary energies of E=0-1000 eV, at incoming angles in interval $-40° \leq \theta \leq 40°$, before and after anti-multipactor treatment.

FIG. 5 discloses the primary energy and angular dependences of the SE yield of electrons colliding with filters surface with primary energies of E=0-1000 eV, at incoming angles in interval $-40°\leq\theta\leq40°$, before and after anti-multipactor treatment.

A relevant decrease of the SEY after anti-multipactor treatment compared with as-received filter is obtained. SEY rises as the incidence angle of primary electrons is increased. The variation is lower for the anti-multipactor coating and higher for the silver flat reference sample. It is remarkable that microstructured coating (coated filter) achieves a constant SEY as a function of the incident angle, and SEY<1 in all primary energy range.

The incident-angle dependence of the total SEY data is well fitted by Furman and Pivi equation $$SEY(\theta)=1+\alpha(1-\cos^{\beta}\theta)$$

A good fit of SEY (θ) (secondary and backscattered electrons) is achieved with a constant value of α=9626.4 and β ranges from $2.82\cdot10^{-5}$ to $4.75\cdot10^{-5}$ for the primary energy range 200-900 eV.

The return loss of these coated Ku band samples, as well as the insertion loss, was measured at Tesat Spacecom by using a network analyzer equipment. S-parameter measurements were performed on each DUT (Device under test) before and after treatment.

A low value of insertion loss was measured, 0.14 dB.

Multipactor test were performed at the European High Power Laboratory in Valencia (Spain). Reference document: ECSS Space Engineering—T\TuHipact.ioll design and t.est RCSS-E-20-01A.

The filter sample was installed inside a vacuum chamber and one $^{90}$Sr radioactive β-source and one UV lamp were employed simultaneously during the tests. A total of two electron probes were used during the test. It is worth mentioning that the detection systems as well as the radioactive source and the optical fiber (UV light) were positioned nearby the critical area of the filter sample.

The filter sample was kept under vacuum for around 60 h before starting the test. No discharges were observed up to at least 15000 W. Once the profile was completed, the RF power was increased progressively up to 15000 W. No discharge was observed. The maximum power attainable in this test-bed is 15000 W. The Multipactor test indicated that not discharge was produced, even at the maximum attainable power of the test bed (15 kW).

The invention claimed is:

1. An anti-multipactor coating deposited onto a substrate consisting of:

at least two contacting high conductive metal layers with an electrical conductivity greater than $4\times10^7$ $S\cdot m^{-1}$, having a secondary electron emission yield below 1 in air, between 0.4 and 0.9 for an incident electron energy range between 0 and 5000 eV, having a final surface roughness defined by a geometric shape of grooves, having a grooves aspect ratio greater than 4 for a surface grooves density greater than 70%, wherein the aspect ratio is defined by the ratio depth to dwell width of the grooves, and having an insertion loss of between 0.1 and 0.14 dB, wherein the substrate is Ni doped with an element selected from P, Al, Cu and Ag.

2. The anti-multipactor coating according to claim 1, wherein the high conductive metal of each layer is selected independently from Ag and Cu.

3. A high power device comprising the anti-multipactor coating of claim 1, wherein the device is a microwave, a radio frequency device for space, thermonuclear or large accelerator instrumentation.

4. A method of manufacturing the anti-multipactor coating deposited onto a substrate according to claim 1, wherein the method comprises:

a) depositing a high conductive metal layer, with an electrical conductivity greater than $4\times10^7$ $S\cdot m^{-1}$, onto a substrate, b) etching the deposited high conductive metal layer of operation (a) by an acid dissolution, c) activating the etched layer obtained in operation (b), and d) electroless plating of a high conductive metal, of an electrical conductivity greater than $4\times10^7$ $S\cdot m^{-1}$, onto the activated etched layer obtained in operation (c) using a solution of high conductive metal ions and a reducing agent.

5. The method according to claim 4, wherein the high conductive metal layer of operation (a) is made of Ag or Cu.

6. The method according to claim 4, wherein depositing in operation (a) is performed by a chemical deposition technique, and/or a physical deposition technique.

7. The method according to claim 6, wherein the chemical deposition technique comprises at least one of plating, chemical solution deposition, spin coating, chemical vapor deposition and atom layer deposition.

8. The method according to claim 6, wherein the physical deposition technique comprises one of electron beam evaporator, molecular beam epitaxy, pulsed laser deposition, sputtering, cathodic arc deposition and electrospray deposition.

9. The method according to claim 4, wherein the acid dissolution of operation (b) comprises hydrofluoric acid, nitric acid, acetic acid, deionized water or a mixture thereof.

10. The method according to claim 4, wherein operation (c) is performed by adding an aqueous solution of $SnCl_2$ or $PdCl_2$.

11. The method according to claim 4, wherein operation (c) is performed by adding an aqueous solution of $SnCl_2$ in a concentration range between 0.05-1.2% in weight to the etched layer obtained in operation (b).

12. The method according to claim 4, wherein the high conductive metal used during operation (d) of electroless plating is selected from Ag or Cu.

13. The method according to claim 4, wherein operation (d) of electroless plating is performed under continuous agitation and using a bath temperature between 30 and 80° C.

14. The method according to claim 4, wherein the solution of high conductive metal ions of operation (d) is an aqueous solution of $AgNO_3$.

15. The method according to claim 4, wherein the reducing agent of operation (d) is selected from triethanolamine, diethanolamine or monoethanolamine.

* * * * *